US006179667B1

(12) United States Patent
Espenshade et al.

(10) Patent No.: US 6,179,667 B1
(45) Date of Patent: Jan. 30, 2001

(54) HIGH FREQUENCY ELECTRICAL CONNECTOR ASSEMBLY WITH FORWARD FACING CONTACT/TERMINAL MEMBER SECURING INSERT

(75) Inventors: Leonard K Espenshade, Harrisburg; Ronald Locati, York; Brian Simmering, Red Lion; Ted Meckley, Seven Valleys, all of PA (US)

(73) Assignee: Stewart Connector Systems, Inc., Glen Rock, PA (US)

( * ) Notice: Under 35 U.S.C. 154(b), the term of this patent shall be extended for 0 days.

(21) Appl. No.: 09/333,365

(22) Filed: Jun. 15, 1999

Related U.S. Application Data

(60) Provisional application No. 60/089,513, filed on Jun. 16, 1998.

(51) Int. Cl.[7] ..... H01R 24/00
(52) U.S. Cl. ..... 439/676; 439/941
(58) Field of Search ..... 439/676, 941, 439/344

(56) References Cited

U.S. PATENT DOCUMENTS 4,566,749 * 1/1986 Johnston ..... 439/676
5,059,140 * 10/1991 Philippson et al. ..... 439/676
5,599,209 * 2/1997 Belopolsky ..... 439/676
5,639,266 * 6/1997 Patel ..... 439/676

* cited by examiner

*Primary Examiner*—Paula Bradley
*Assistant Examiner*—Tho dac Ta
(74) *Attorney, Agent, or Firm*—Steinberg & Raskin, P.C.

(57) ABSTRACT

A high frequency electrical connector assembly including a housing defining a plug-receiving receptacle having an entrance opening and contact/terminal members arranged in the housing. The contact/terminal members include at least one forward facing contact/terminal member having a forward facing contact situated in the receptacle and a non-contact portion including a terminal. The forward facing contact has a rearward end coupled to the terminal and a forward end which is closer to the entrance opening than the rearward end. The housing includes an outer housing part and an insert assembly insertable into the outer housing part to define the plug-receiving receptacle and including a securing insert for firmly securing the forward facing contact/terminal member(s) in the housing. The securing insert itself may be secured in connection with the housing to prevent movement thereof.

30 Claims, 9 Drawing Sheets

PAIR 3

PAIR 1
PAIR 4
PAIR 2
4
10
104
26
112
POS'N
P1
P2
P3
P4
P6
P7
P8
28a
28a
28b
28a
28a
28b
P5
110
108
108
106
22
22
32a
32b
32a
4
32b
32a
32a

HIGH FREQUENCY ELECTRICAL CONNECTOR ASSEMBLY WITH FORWARD FACING CONTACT/TERMINAL MEMBER SECURING INSERT

CROSS-REFERENCE TO RELATED APPLICATIONS

This application claims priority under 35 U.S.C. §119(e) of U.S. provisional patent application Ser. No. 60/089,513 filed Jun. 16, 1998.

This application is related to U.S. patent application Ser. No. 08/507,468 filed Aug. 23, 1995, now U.S. Pat. No. 5,791,942, which is a continuation-in-part of U.S. patent application Ser. No. 08/327,425 filed Oct. 21, 1994, now U.S. Pat. No. 5,639,266, which in turn is a continuation-in-part of U.S. patent application Ser. No. 08/179,983, now abandoned. All of these related applications are incorporated by reference herein.

FIELD OF THE INVENTION

The present invention relates generally to electrical connector assemblies and, more particularly, to an electrical connector assembly for use in the transmission of high frequency signals.

The present invention also relates to an insert assembly for placement in a connector assembly, such as in lower receptacles of a multi-level connector assembly with an offset or non-offset arrangement of receptacles.

BACKGROUND OF THE INVENTION

Data communication networks are being developed which enable the flow of information to ever greater numbers of users at ever higher transmission rates. A problem is created, however, when data is transmitted at high rates over a plurality of circuits of the type that comprise multi-pair data communication cable. In particul transmits and receives electromagnetic radiation so that the signals flowing through one circuit or wire pair (the "source circuit") may couple with the signals flowing through another wire pair (the "victim circuit"). The unintended electromagnetic coupling of signals between different pairs of conductors of different electrical circuits is called crosstalk and is a source of interference that often adversely affects the processing and integrity of these signals. The problem of crosstalk in information networks increases as the frequency of the transmitted signals increases.

In the case of local area network (LAN) systems employing electrically distinct twisted wire pairs, crosstalk occurs when signal energy inadvertently "crosses" from one signal pair to another. The point at which the signal crosses or couples from one set of wires to another may be 1) within the connector or internal circuitry of the transmitting station, referred to as "near-end" crosstalk, 2) within the connector or internal circuitry of the r receiving station, referred to as "ear-end crosstalk", or 3) within the interconnecting cable.

Near-end crosstalk ("NEXT") is especially troublesome in the case of telecommunication connectors of the type specified in sub-part F of FCC part 68.500, commonly referred to as modular connectors. Such modular connectors include modular plugs and modular jacks. The EIA/TIA of ANSI has promulgated electrical specifications for near-end crosstalk isolation in network connectors to ensure that the connectors themselves do not compromise the overall performance of the unshielded twisted pair interconnect hardware typically used in LAN systems. The EIA/TIA Category 5 ("Cat-5") electrical specifications specify the minimum near-end crosstalk isolation for connectors used in 100 ohm unshielded twisted pair Ethernet type interconnects at speeds of up to 100 MHz.

While it is desirable to use modular connectors for data transmission for reasons of economy, convenience and standardization, the standard construction of modular jacks inherently results in substantial near-end crosstalk at high frequency operation. In particular, conventional modular jacks generally comprise a plurality of identically configured contact/terminal members that extend parallel and closely spaced to each other thereby creating the possibility of excessive near-end crosstalk at high frequencies.

To reduce the possibility of near-end crosstalk, a high frequency electrical connector assembly is disclosed in U.S. Pat. Nos. 5,639,266 and 5,791,942 (Patel), incorporated by reference herein, and includes two different constructions of contact/terminal members. Specifically, a portion of the contact/terminal members include a "forward facing" contact portion while a remaining portion have a "rearward facing" contact portion. The forward facing contact portions each include a rearward end nearer to the closed end of the connector which is electrically coupled to a respective terminal whereby a forward end of each forward facing contact portion constitutes a free forward end which faces toward the entrance opening of the connector. By contrast, the rearward facing contact portions each include a forward end nearer the entrance opening of the connector assembly which is electrically coupled to a respective terminal whereby a rearward end of each rearward facing contact portion constitutes a free rearward end which faces away from the entrance opening. The forward and rearward facing contact portions are substantially parallel and laterally adjacent to one another.

In one manner of assembly of the connector assembly, the contact/terminal members with a forward facing contact portion are inserted into a contact housing part through a notch formed in the front wall of the contact housing part adjacent the upper surface thereof so that the terminal of each of these contact/terminal member is positioned within a bore in a back portion of the contact housing part and the forward end of the contact portion of each contact/terminal member overlies an upwardly facing stop surface at a front portion of the contact housing part. On the other hand, the contact/terminal members with a rearward facing contact portion are inserted into the contact housing part so that a conductor portion of each contact/terminal member lies flush with an upper surface of the contact housing part. As such, when the contact housing part is inserted into the outer housing part, the contact/terminal members with a rearward facing contact portion are securely pressed between the contact housing part and the outer housing part. However, in view of the depth to which the contact/terminal members with a forward facing contact portion are recessed within the contact housing part, these contact/terminal members cannot be firmly held in place by means of the contact housing part and outer housing part alone. The absence of a firm hold of these contact/terminal members may cause failure when handling the connector assembly during installation on a printed circuit board and during routine mechanical cycling function of the connector assembly.

In view of the foregoing, several techniques have been contemplated in order to firmly secure the contact/terminal members with a forward facing contact portion in the connector assembly.

One method is to apply an amount of epoxy to one or more portions of each contact/terminal member with a forward facing contact portion which engage the connector housing. However, the use of existing epoxies to retain components in an electrical connector assembly is not widely accepted because the epoxy can flow before curing into an area which it will restrict the intended movement of the contact/terminal members, cover insulation material or conductive surfaces, or otherwise prove to be unreliable over the life of the connector assembly.

Another method is to heat stake the contact/terminal members with a forward facing contact portion. This method entails the intentional reflowing of plastic material, i.e., heating a plastic portion formed on the connector housing for this purpose, over one or more portions of the contact/terminal members so that upon re-solidification of the plastic material, the contact/terminal members are firmly embedded in connection with the connector housing. However, heat staking often fails to provide a reliable bond and may therefore cause failure during routine handling of the connector assembly when installing the same on a printed circuit board and during routine mechanical cycling function of the connector assembly.

OBJECTS AND SUMMARY OF THE INVENTION

Accordingly, it is an object of the present invention to provide new and improved connector assemblies for use in data transmission at high frequencies including forward facing contact/terminal members, i.e., a contact/terminal member with a forward facing contact, which are held securely within the connector assemblies.

Another object of the present invention is to provide new and improved high frequency connector assemblies which reduce near-end crosstalk and include forward facing contact/terminal members which are held securely within the connector assemblies.

Still another object of the present invention is to provide new and improved modular connector assemblies which reduce near-end crosstalk and include forward facing contact/terminal members which are held securely within the connector assemblies.

A still further object of the present invention is to provide new and improved high frequency electrical connector assemblies which reduce near-end crosstalk and which are simple and inexpensive in construction and include forward facing contact/terminal members which are held securely within the connector assemblies.

Yet another object of the present invention is to provide new and improved modular jacks which reduce near-end crosstalk when connected to modular plugs that terminate high speed data transmission cable according to ANSI/EIA/TIA standard 568 and include forward facing contact/terminal members which are held securely within the jacks.

Briefly, these and other objects are attained by arranging a securing insert in an insert assembly of a housing of the connector assembly in a position to firmly secure any forward facing contact/terminal members in the housing. More particularly, the securing insert engages part of a non-contact portion of the forward facing contact/terminal member(s), i.e., a portion which does not engage a contact blade of a mating plug, and even more specifically, a conductor or intermediate conductor portion arranged between a rearward end of the forward facing contact and an associated terminal. The housing includes an outer housing part, which may define one or more plug-receiving receptacles, and the insert assembly further includes a contact housing part, which together with the outer housing part define the receptacle(s) for the mating plug(s). The contact housing part includes a notch into which the securing insert is insertable. The conductor of each forward facing contact/terminal member overlies a surface defining the notch such that a portion thereof is positioned between the securing insert and the surface of the contact housing part defining the notch. Any force exerted against the securing insert will thus cause the conductors to be urged against the contact housing part preventing undesirable movement of the forward facing contact/terminal members. To this end, a conductor of a rearward facing contact/terminal member passes through a channel in the top wall of the securing insert and, after the rearward facing contact/terminal member is bent around a front portion of the contact housing part, the securing insert is maintained thereby in its position between the conductors of the forward facing contact/terminal members and the conductor of the rearward facing contact/terminal member. After the contact housing part is inserted into an outer housing part, upper surfaces of the securing insert abut against opposed interior surfaces of the outer housing part resulting in the securing insert, and thus the forward facing contact/terminal members, being firmly held in the housing.

In one particularly advantageous embodiment, the contact housing part and securing insert include cooperating securing means for securing the securing insert in connection with the contact housing part, i.e., in the notch. The cooperating securing means may comprise latches arranged on the front face of the contact housing part and projections defined on a front face of the securing insert whereby the securing insert is pressed between the latches into a position below the latches and between portions of the contact housing part such that removal of the securing insert from the contact housing part is prevented. In this manner, a discrete assembly is obtained which can be transferred and shipped as a unit.

Moreover, in the connector assembly in accordance with the invention, by providing both forward and rearward facing contact/terminal members, capacitive coupling is reduced by reducing the total surface area that is capable of storing charge between pairs of interconnected contacts, and inductive coupling is reduced by reducing magnetic field coupling between signal pairs by using asymmetrical contact pairs to tilt the axis of the contact pair's loop current, i.e. by tilting or skewing the path in which the signal current flows through the contact pair. Thus, in a preferred embodiment, the modular connector assembly has a plurality of contact/terminal members, each of which defines a contact, a pin-like terminal, and a conductor portion interconnecting the contact and terminal. The contact/terminal members of a first set each have a "rearward facing" configuration, i.e., the free end of the contact faces toward the closed end of the connector assembly with the respective terminal being interconnected to the contact at the region of the open end of the connector assembly. The connector assembly is provided with a second set of contact/terminal members, each of which is configured to define a contact that "faces forwardly", i.e., the free end of the contact faces toward the open end of the connector assembly with the respective terminal being interconnected to the contact at the region of the closed end of the connector assembly.

In the case of an eight contact, eight position modular jack adapted for connection to a modular plug terminating an eight wire (four signal pairs) cable in accordance with the wire-contact assignments specified by ANSI/EIA/TIA standard 568, near-end crosstalk is reduced to a substantial extent by providing the pairs of contact/terminal members assigned to terminate wire or signal pairs "1" and "3" with asymmetrical configurations. Specifically, the contact/terminal members at positions 4 and 5 which terminate wire pair "1" have asymmetrical configurations, while the contact/terminal members at positions 3 and 6 which terminate wire pair "3" have asymmetrical configurations.

BRIEF DESCRIPTION OF THE DRAWINGS

A more complete appreciation of the present invention and many of the attendant advantages thereof will be readily understood by reference to the following detailed description when considered in connection with the accompanying drawings in which.

DETAILED DESCRIPTION OF THE PREFERRED EMBODIMENTS

Figure 1:
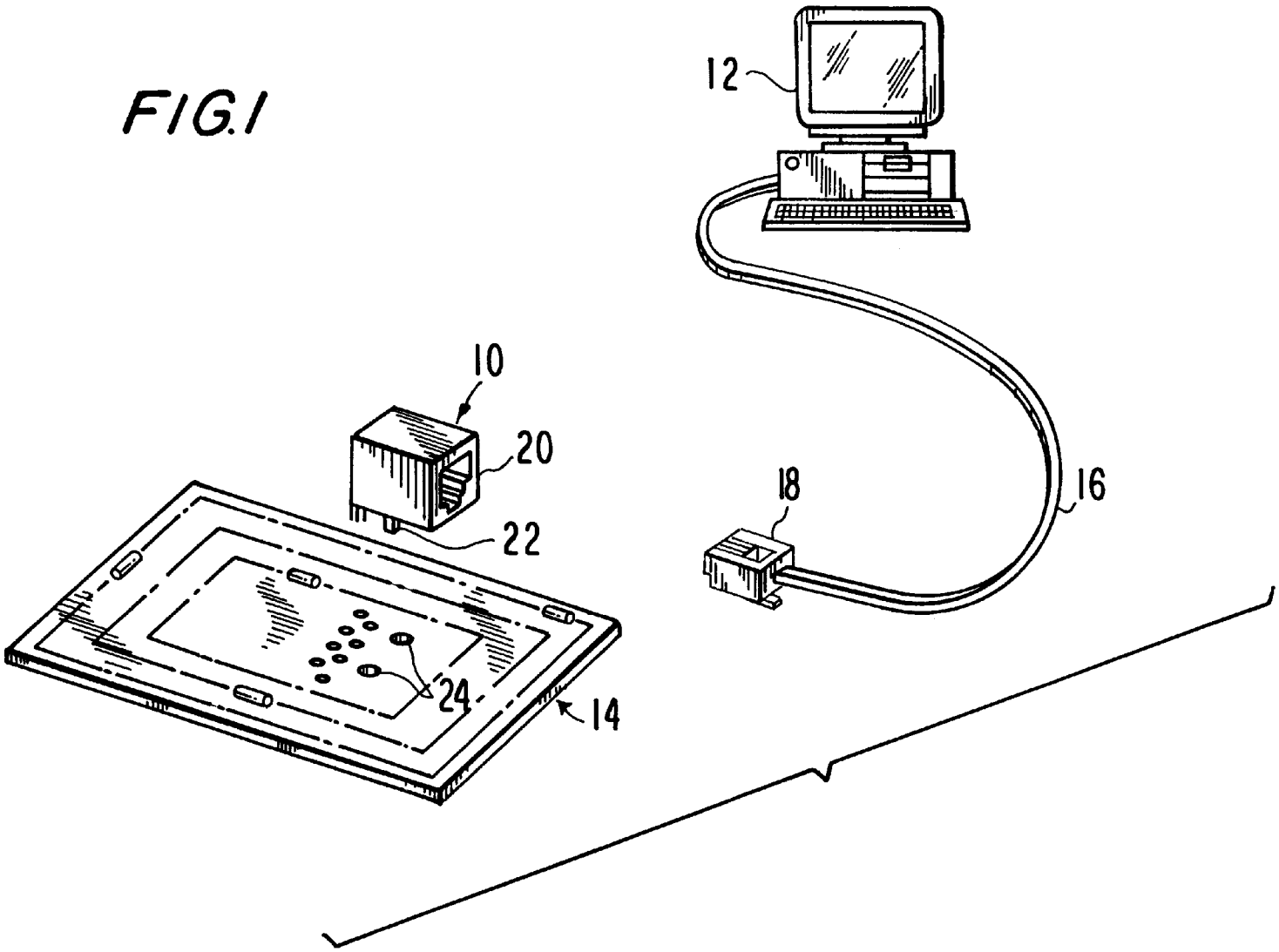
FIG. 1 shows an exploded schematic perspective view of a connector assembly in use for coupling high speed communication equipment to a printed circuit board via a communication cable terminated by a modular plug.

Referring now to the drawings wherein like reference characters designate identical or corresponding parts throughout the several views, FIG. 1 illustrates the use of a connector assembly 10 for coupling high speed communication hardware 12 to a printed circuit board 14 via a high speed communication cable 16 terminated by a modular plug 18. The connector assembly 10 has a receptacle 20 adapted to receive the modular plug 18. Coupling of the hardware 12 to the printed circuit board 14 is made more convenient by the use of connectors, i.e., connector assembly 10 and plug 18, having standard modular features of the type specified in sub-part F of F.C.C. part 68.500. The connector assembly 10 is mechanically mounted to the printed circuit board 14 by means of posts 22 which are received in corresponding openings 24 in the printed circuit board 14.

As noted above, problems arise in the use of conventional modular connector assemblies for high speed data transmission because of the necessary close spacing between the contacts thereof and other electrical conductors of the connector assembly. More particularly, modular connector assemblies generally include a plurality of closely spaced, substantially parallel contacts adapted to be engaged by blade-like contacts of the modular plugs. The wire contacts are coupled to pin-like terminals of the connector assembly, generally by length portions of common contact/terminal members, which in turn are connected to the printed circuit board. When a modular plug is inserted into the receptacle of a modular connector assembly, the contact blades of the plug engage respective wire contacts of the connector assembly so that a force is exerted by the contact blades against the wire contacts to thereby maintain electrical contact between the contact blades and the wire contacts. The signals flowing between the wire contacts and the pin-like terminals of each transmission circuit create electromagnetic and inductive fields which undesirably couple to other circuits resulting in near-end crosstalk.

In accordance with the illustrated embodiment of the invention, the jack contact/terminal members of the respective pairs that terminate cable signal pairs 1 and 3 are specially constructed to reduce capacitive and inductive coupling throughout the connector.

Referring to FIGS. 2–8, the connector assembly 10 in accordance with a preferred embodiment of the invention comprises a dielectric housing 26 and a plurality of conductive contact/terminal members 28*a* and 28*b*. Contact/terminal members 28*a*, of which there are six, are configured to form a first set of rearward facing contacts or contact portions 30*a* and associated pin-like terminals or terminal portions 32*a*. Contact/terminal members 28*b*, of which there are two, are configured to form a second set of forward facing contacts or contact portions 30*b* and associated non-contact portions, the non-contact portion of each contact/terminal member 28*b* including all of the contact/terminal member except for the forward facing contact 30*b*. Each non-contact portion thus includes an associated pin-like terminal or terminal portion 32*b*. The forward facing contacts 30*b* each have a forward end 34 and a rearward end 36 closer to terminal 32*b* and which is farther from an entrance opening 38 of the receptacle 20 than the forward end 34 when the contact/terminal members 28*b* are installed in housing 26. A free end or end tip portion 40 of the contact/terminal member 28*b* is arranged at the forward end 34, facing the entrance opening 38 in the illustrated embodiment. The rearward facing contacts 30*a* each have a forward end 42 and a rearward end 44 which is farther from the entrance opening 38 of the receptacle 20 than the forward end 42 when the contact/terminal members 28*a* are installed in housing 26. A free end or end tip portion 46 is arranged at the rearward end 44, facing the closed end of the receptacle 20. As such, the end tip portions 46 of contact/terminal members 28*a* are situated near, and face toward, the closed end of jack receptacle 20 while the end tip portions 40 of contact/terminal members 28*b* are situated near and face toward the entrance opening 38 of receptacle 20.

Connector assembly 10 includes eight contacts 30 (six contacts 30*a* and two contacts 30*b*) and is constructed specifically for use with an eight contact modular plug terminating a four wire pair transmission cable with wire-contact assignments as specified by ANSI/EIA/TIA standard 568. However, it is understood that a connector in accordance with the principles of the invention may include more or less than eight contacts.

The contacts 30*a* and 30*b* are substantially parallel and extend obliquely through jack receptacle 20 between upper positions proximate to the entrance opening 38 and lower positions at the rear of the receptacle 20. In the present context, it is understood that the term "substantially parallel" is broad enough to cover a construction in which the contacts 30*a* and 30*b* define a small angle at α (FIG. 4) between them. The angle a can vary between from 0°, in which case the contacts 30*a* and 30*b* are in a common plane or in spaced apart, parallel planes, to about 10°.

The contact/terminal members 28*a* and 28*b* are shaped and associated with jack housing 26 as described below so that when the contacts 30*a* and 30*b* are engaged by the contact blades 5 48 (shown in phantom in FIG. 4) of the modular plug 18, the signals flow through the rearward facing contacts 30*a* to their associated terminals 32*a* and the signals flow through the forward facing contacts 30*b* toward their associated terminals 32*b*. The contacts 30*a*,30*b* are shown in their deflected position in FIG. 4.

Each of the six "rearward" contact/terminal members 28*a* is formed of an appropriate resilient conductive material, such as phosphor bronze, and is shaped to include a length portion defining the rearward facing contact 30*a*, the end tip portion 46 arranged at the rearward end of the contact 30*a*, a length portion defining the associated pin-like terminal 32*a* and a length portion defining a conductor 72*a* interconnecting the contact 30*a* from its forward end 42 to terminal 32*a*.

Each of the two "forward" contact/terminal members 28*b* is also formed of resilient conductive material and is shaped to include a length portion defining the forward facing contact 30*b*, the end tip portion 40 arranged at the forward end 34 of the contact 30*b*, a length portion defining the associated pin-like terminal 32*b* and a length portion defining a conductor 72*b* interconnecting the contact 30*b* from its rearward end 36 to terminal 32*b*.

Figure 3:
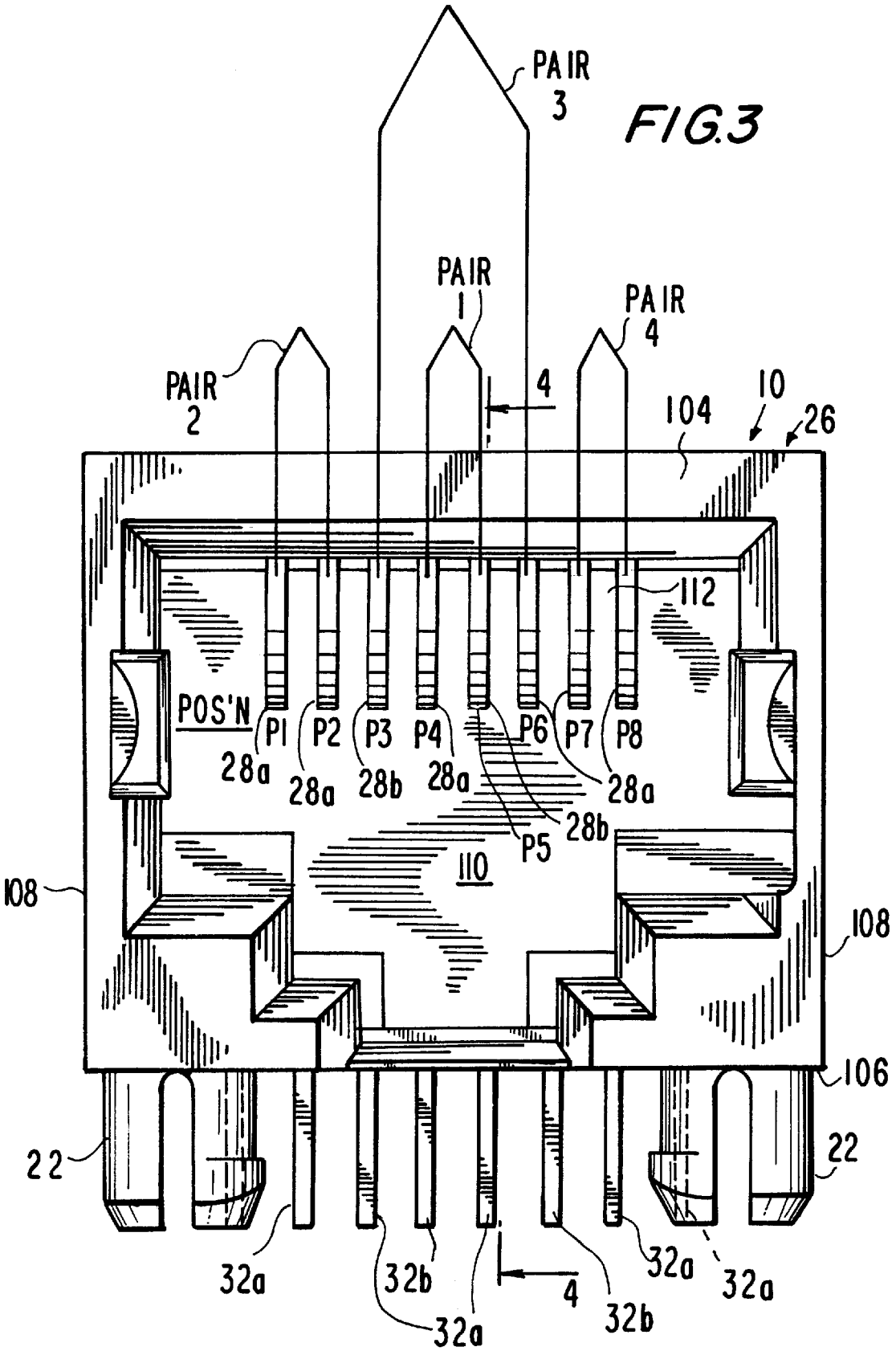
FIG. 3 is a front elevation view of the connector assembly in accordance with the invention illustrating the wire-plug contact assignments specified for a mating plug by ANSI/EIA/TIA standard 568 by reference to the contacts to be engaged by those plug contacts.
Figure 4:
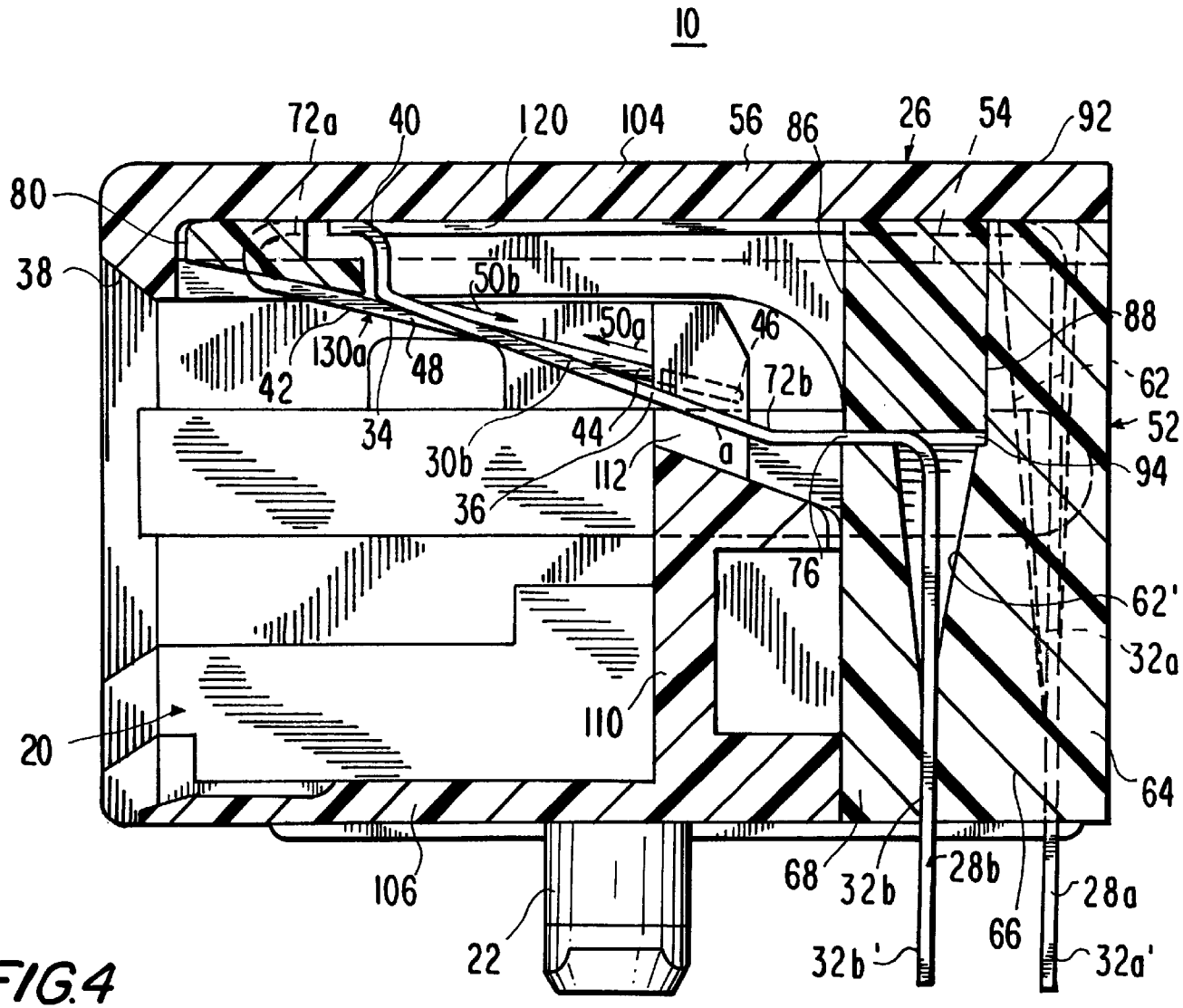
FIG. 4 is a longitudinal section view of the connector assembly illustrated in FIGS. 2 and 3 taken along line 4—4 of FIG. 3.

The forward facing contact/terminal members 28*b* are positioned with respect to the rearward facing contact/terminal members 28*a* in accordance with an arrangement which has been found to provide substantial isolation of near-end crosstalk when connector assembly 10 is coupled to a modular plug whose contacts are assigned to terminate the cable wires according to ANSI/EIA/TIA standard 568. With reference to FIG. 3, twisted wire or cable signal pair "3" assigned to plug/jack contacts at positions "P3" and "P6" is typically used to transmit and receive information in such cable, and in accordance with the invention, the jack contact/terminal members situated at positions "P3" and "P6" have asymmetrical forward and rearward facing configurations. Likewise, the jack contacts that are situated at positions "P4" and "P5" which are engaged by corresponding plug contacts that terminate the twisted wire pair designated "1"are asymmetrical, rearward and forward facing contacts 30*a* and 30*b*. In the illustrated embodiment, the jack contacts situated at positions "P1"and "P2" which are engaged by corresponding plug contacts that terminate twisted wire pair "2" are both rearward facing contacts 30*a* as are the jack contacts situated at positions "P7" and "P8" that are engaged by corresponding plug contacts that terminate twisted wire pair "4". It has been found that with this particular positional arrangement of the eight forward facing (F) and rearward facing (R) jack contacts, i.e., RRFRFRRR, optimum isolation for source/victim twisted wire pairs "1" and "3" (which generally generate the greatest NEXT) is achieved when coupled to an eight position modular plug whose contacts are assigned to terminate 4 twisted wire pair cable according to ANSI EIA/TIA standard 568. This is accomplished without introducing additional NEXT failures associated with the jack contacts at positions "P4"–"P5" (wire pair"1") and the jack contacts at positions "P1"–"P2" (wire pair"2") or"P7"–"P8" (wire pair"4").

Housing 26 comprises a contact housing part 52, a securing insert 54 and an outer housing part 56, all of which are formed of suitable plastic material. As shown in the preferred embodiment of FIG. 2, contact housing part 52 is separate from securing insert 54 and securing insert 54 has a width less than that of the contact housing part 52. Contact housing part 52 and outer housing part 56 together define the receptacle 20 for receiving a modular plug of the type designated 18 in FIG. 1. Securing insert 54 is insertable into the contact housing part 52 to urge the contact/terminal members 28*b* into engagement with the contact housing part 52. In turn, the securing insert 54 is securely held between the contact housing part 52 and the outer housing part 56 so that part of a non-contact portion of the contact/terminal members 28*b*, specifically a 5 portion of the conductor 72*b* in the illustrated embodiment, is pressed against the contact housing part 52. The position of the contact/terminal members 28*b* is thus reliably secured so that the contact/terminal members 28*b* are not susceptible to movement during installation of the connector assembly 10 on a printed circuit board or insertion of the plug 18 into the receptacle 20.

Contact housing part 52, securing insert 54 and contact/terminal members 28*a*,28*b*, taken together, can be considered to constitute an insert assembly as such an assembly is insertable into a variety of different outer housing parts, i.e., not only the outer housing part 56 shown in the illustrated embodiment. For example, the insert assembly is insertable into an outer housing part defining a plurality of receptacles in a single row, each receivable of one insert assembly. The outer housing part could also include a plurality of rows, in which case, the insert assembly would be most appropriately suitable for the lower row of receptacles, although it is conceivable that this would not always be the case.

During installation of the connector assembly 10 on a printed circuit board, the terminals 32*b* might be urged upward and consequently move the forward facing contacts 30*b* out of a position in which they will engage the contact blades of the mating plug. In accordance with the invention, such upward movement of the terminals 32*b* is prevented by the placement of securing insert 54 above the conductor 72*b*. During insertion of the plug 18 into the receptacle 20, the blades 48 on the plug 18 (FIG. 4) engage a respective contact 30*a*,30*b* of the contact/terminal members 28*a*,28*b* and exert an upwardly directed force to the contact/terminal members 28*a*,28*b*. The placement of the securing insert 54 above the conductor 72*b* of the contact/terminal members 28*b* therefore serves to prevent upward movement of the conductor 72*b*, and maintain the forward facing contacts 30*b* with the required resiliency in engagement with the blades 48 on the plug 18.

Contact housing part 52 has a generally L-shaped configuration including a back portion 58 and a frame-shaped top portion 60 extending from the top of the back portion 58 in a cantilever fashion. A first set of four tapered parallel bores 62 extend through the rear part of the back portion 58 between a rear wall 64 and an intermediate wall 66 of the contact housing part 52. A second set of four tapered parallel bores 62 extend through the front part of back portion 58 between the intermediate wall 66 and a front wall 68 of the contact housing part 52. The top surface of intermediate wall 66 and front wall 68 each include channels 70 through which the conductors 72*a* of the contact/terminal members 28*a* extend, and as such, the depth of channels 70 is substantially equal to the height of the conductors 72*a* of the contact/ terminal members 28*a*. In this manner, the upper surface of the back portion 58 of the contact housing part 52 and the upper surface of the conductor 72*a* of the contact/terminal members 28*a* are substantially coplanar.

Figure 5:
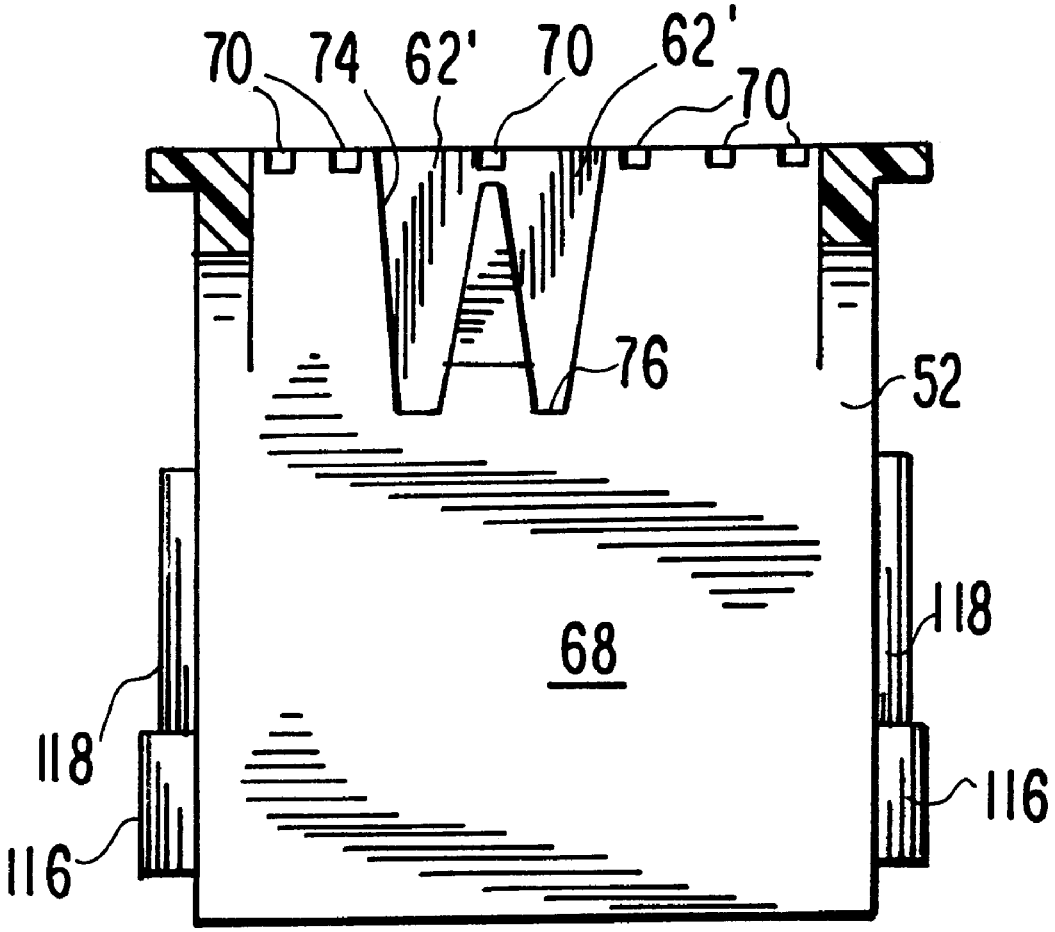
FIG. 5 is a section view of the contact housing part of the connector assembly illustrated in FIGS. 2 and 4 taken along the line 5—5 of FIG. 2.

As best seen in FIG. 5, the central upper region of the front wall 68 contiguous with the upper surface of the back portion 58 is notched out at 74 so that the two of the four bores 62, designated 62', that extend through the front part of back portion 58 at locations corresponding to contact positions 3 and 5, open onto an upwardly facing surface 76 situated at about the mid-height of the front wall 68 of the back portion 58. Thus, six full height bores 62 open onto the top surface of back portion 58 while two bores 62' open onto the surface 76 situated at the mid-height of the back portion 58.

Figure 6:
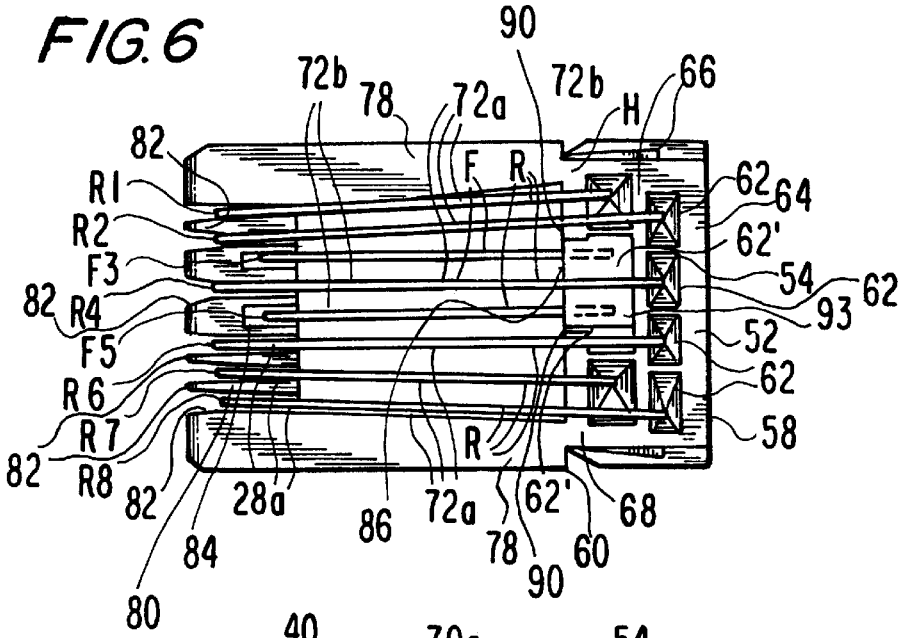
FIG. 6 is a top plan view of an assembly of the contact housing part and contact/terminal members of the connector assembly illustrated in FIGS. 2–4.
Figure 7:
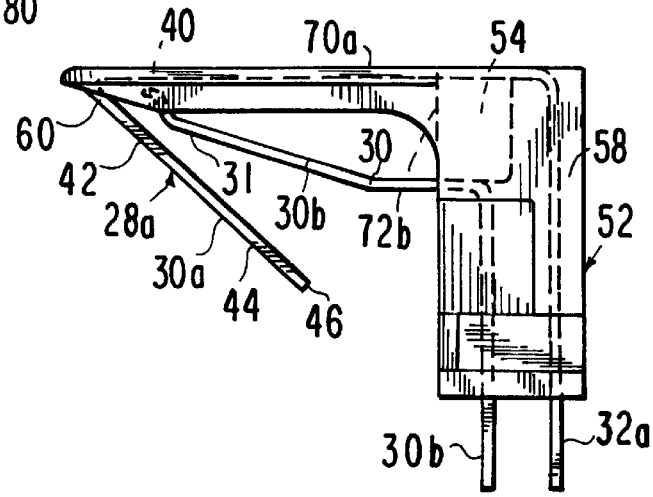
FIG. 7 is a side elevation view of the assembly illustrated in FIG. 6.
Figure 8:
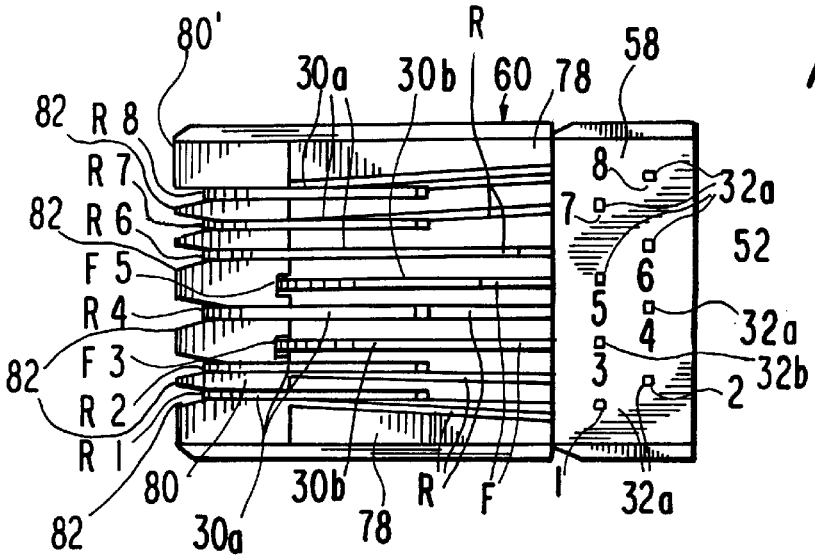
FIG. 8 is a bottom plan view of the assembly illustrated in FIGS. 6 and 7.

The frame-shaped top portion 60 includes a pair of elongate side portions 78 projecting forwardly from the upper end of back portion 58 and a transversely extending front portion 80 extending transversely between side portions 78. Guide channels 82 are formed on the upper surface of front portion 80 at locations corresponding to contact positions P1, P2, P4 and P6–P8, i.e., at locations corresponding to the positions of rearward facing contacts 30*a* and curve around to the lower surface of the front portion 80 with the curved portion recessed behind the front surface 80' of front portion 80. As seen in FIG. 6, the transverse front portion 80 has upwardly facing stop surfaces 84 formed at locations corresponding to contact positions P3 and P5, i.e., at locations corresponding to the positions of forward facing contacts 30*b*.

The securing insert 54 comprises a unitary member formed by a front wall 86, a rear wall 88, opposed side walls 90, a top wall 92 and a bottom wall 94. The shape of front wall 86 is substantially the same as the shape of the notch 74 in the front wall 70 of the back portion 58 of the contact housing part 52. A shoulder 96 is formed at each lateral edge of the front wall 86 and is recessed a distance substantially equal to the thickness of the front wall of the contact housing part 52. A notch 98 is formed in the bottom wall 94 in order to form a pair of tapering legs 100. A channel 102 is formed in the top wall 92 extending between the front wall 86 and the rear wall 88 and since it is adapted to receive one of the contact/terminal members 28*a*, it has a depth substantially equal to the height thereof.

The outer housing part 56 comprises a unitary member formed by opposed top and bottom walls 104 and 106 and opposed side walls 108 defining an interior space between them. The posts 22 project downwardly from the bottom wall 106 for connecting the connector assembly to the printed circuit board. If desired, a pair of flanges projecting laterally from side walls 108 may be provided for facilitating mounting of the connector assembly to a chassis.

A wall 110 extends upwardly from bottom wall 106 and divides the interior of the outer housing part 56 into a forward space comprising receptacle 20 in which the modular plug is received and a rearward space for receiving the back portion 58 of contact housing part 52. A plurality of spaced partitions 112 are formed at the upper end of wall 110 that define eight guide slots 114 between them and which terminate at their upper ends at a distance spaced from the top wall 104 of outer housing part 56.

The connector assembly 10 is assembled as follows.

First, the two forward contact/terminal members 28*b* are assembled to contact housing part 52 as follows. The pin-like terminal 32*b* of each contact/terminal member 28*b* is positioned in a respective one of the two shorter bores 62' and has a length such that a bottom length portion 32*b'* projects out from the bottom of bore 62' for connection to the printed circuit board or other substrate. After positioning the contact/terminal members 28*b*, each conductor 72*b* extends longitudinally from the upper end of a respective terminal 32*b* for a relatively short distance, each contact 30*b* extends forwardly in an upward, inclined direction from the front end of a respective conductor 72*b* and each end tip portion 40 overlies a respective one of the stop surfaces 84 (FIG. 6) formed in front portion 80.

The securing insert 54 is then inserted into the notch 74 formed in the contact housing part 52 such that each tapering leg 100 enters into a respective one of the shorter bores 62' and the recessed shoulders 96 accommodate the front wall 68 of the contact housing part 52. Each tapering leg 100 of the securing insert 54 thus engages the conductors 72*b* of a respective one of the contact/terminal members 28*b* which is part of the non-contact portion thereof.

Figure 2:
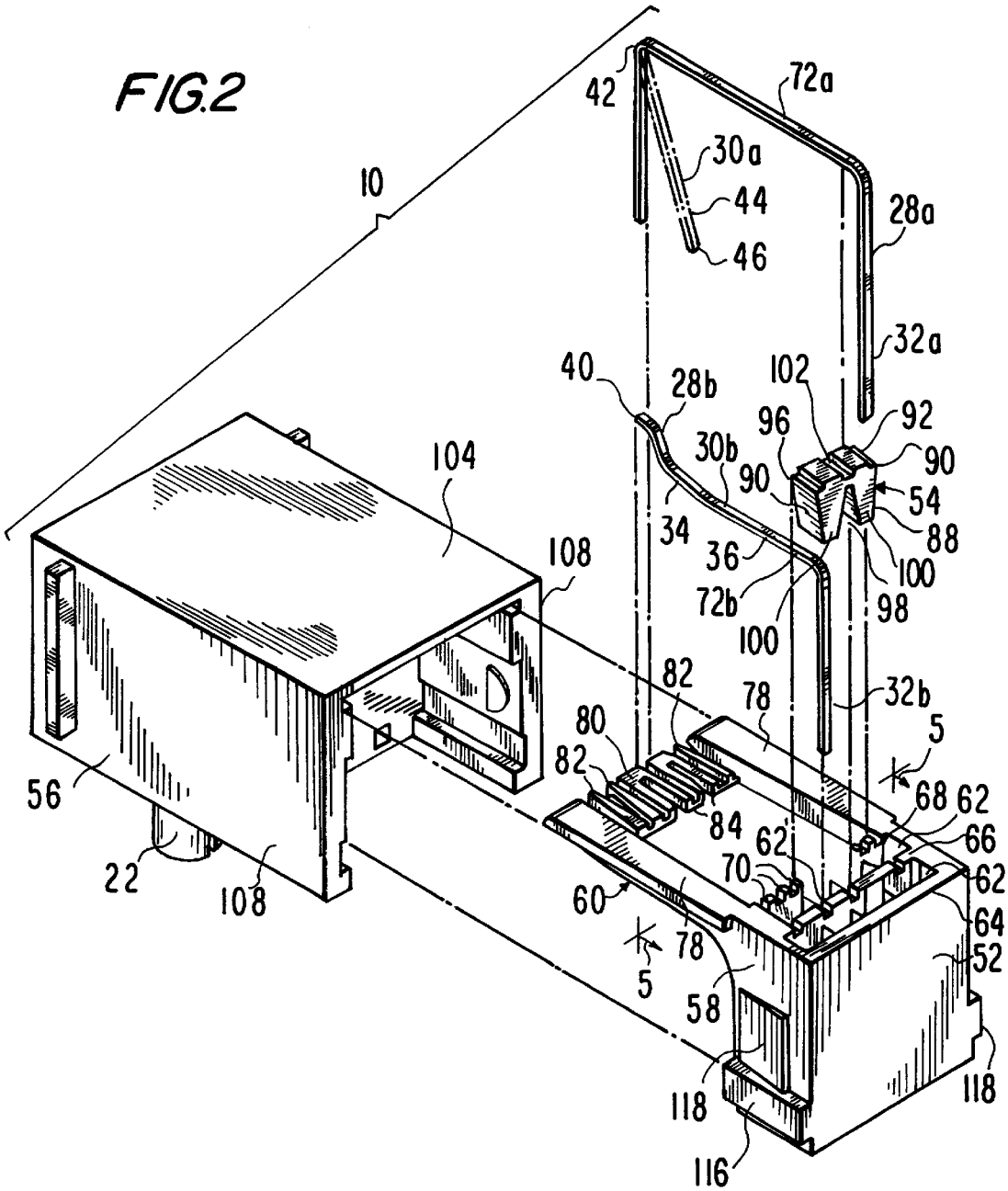
FIG. 2 is an exploded view of a connector assembly in accordance with the invention.

The six rearward contact/terminal members 28*a* are then assembled to contact housing part 52 as follows. The pin-like terminal 32*a* of each contact/terminal member 28*a* having the shape shown in FIG. 2 is positioned in a respective one of the six full height bores 62 and each pin-like terminal 32*a* has a length such that a bottom length portion 32*a'* projects out from the bottom of bore 52 for connection to the printed circuit board or other substrate. After positioning the contact/terminal members 28*a*, each conductor 72*a* extends longitudinally from the upper end of a respective terminal 32*a* across the open space defined by frame-shaped top portion 60 and is received in a respective one of the guide channels 82 formed in front portion 80. The contact 30*a* of each contact/terminal member 28*a* is then bent to extend rearwardly in a downward direction (represented by the phantom lines in FIG. 2) from the curved forward end 42 of a respective conductor 72*a* situated in a guide channel 68 and the contact/terminal member 28*a* terminates at the end tip portion 46. The contact/terminal members 28*a* are held in a secure position in connection with the contact housing part 52 by means of the bend formed about the front portion 80 of the contact housing part 52.

The conductor 72*a* of the rearward contact/terminal members 28*a* in contact position "P4" extends through the channel 102 formed in the top wall 92 of securing insert 54. As such, once the contact 30*a* of this contact/terminal member 28*a* is bent about the front portion 80 of the contact housing part 52, it exerts a force pressing the securing insert 54 in the notch 74 against the conductor 72*b* of the contact/terminal members 28*b* which is thus urged against adjacent surfaces defining notch 74. The contact/terminal members 28*b* will thus be firmly held in the sub-assembly of the contact housing part 52, securing insert 54 and contact/terminal members 28*a*,28*b*.

The conductor 72*a* of the rearward contact/terminal members 28*a* in contact positions "P1", "P2", "P6", "P7", "P8" extends through a respective channel 70 formed in the top surface of the intermediate wall 66 and front wall 68 of the contact housing part 52.

The sub-assembly of the contact housing part 52, securing insert 54 and contact/terminal members 28*a* and 28*b* is then inserted into the outer housing part 56 from its rear end. Rails 116 on the contact housing part 52 are received in corresponding channels (not shown) formed in the outer housing part 56. During insertion, the six rearward facing contacts 30*a* are aligned with and received in the guide slots 114 corresponding to jack contact positions 1, 2, 4 and 6–8, while the two forward facing contacts 30*b* are aligned with and received in the guide slots 114 corresponding to jack contact positions 3 and 5. The partitions 112 serve to precisely position the rearward and forward facing contacts 30*a* and 30*b* and prevent them from contacting each other during operation. A locking shoulder 118 formed on each side of the back portion 58 of contact housing part 52 snaps into engagement with a corresponding shoulder (not shown) in the outer housing part 56 to lock the contact housing part 52 and associated securing insert 54 and contact/terminal members 28*a*, 28*b* to the outer housing part 56. Further, the conductor 72*a* of each contact/terminal member 28*a* lies opposite a lower surface 120 of the top wall 104 of the outer housing part 56, as there may be a small tolerance between the conductors 72*a* and the lower surface 120, whereas the upper surface of the securing insert 54 abuts against the lower surface 120 of the top wall 104 of the outer housing part 56 so that the securing insert is held firmly in place and the fixing of the contact/terminal members 28*b* is maintained.

The charge stored between asymmetrically configured forward and rearward facing jack contact/terminal members 28*b* and 28*a* at positions "P3" and "P6" that terminate signal pair 3 is substantially reduced as compared to the charge that would be stored in the case, for example, where two rearward facing contact/terminal members were situated at those positions. Similarly, the axis of the loop current flowing through asymmetrical contact/terminal wire pairs is tilted or skewed thereby reducing magnetic field coupling between signal pairs relative to the case where the contact/terminal members were identically configured. In this manner, both capacitive and inductive coupling is reduced.

The arrangement of forward and rearward facing contacts described above, namely RRFRFRRR will essentially compensate for a split twisted pair where the normal pairing is split up and the individual wires are paired with wires from another pair. However, the invention is not limited to such an arrangement, and alternate wiring configurations will dictate notating forward and rearward facing contacts for optimum cancellation or compensation effects. For example, other arrangements of forward and rearward facing contacts in a connector in accordance with the invention include RFRFRRRR and FRFRRRRR.

Figure 9:
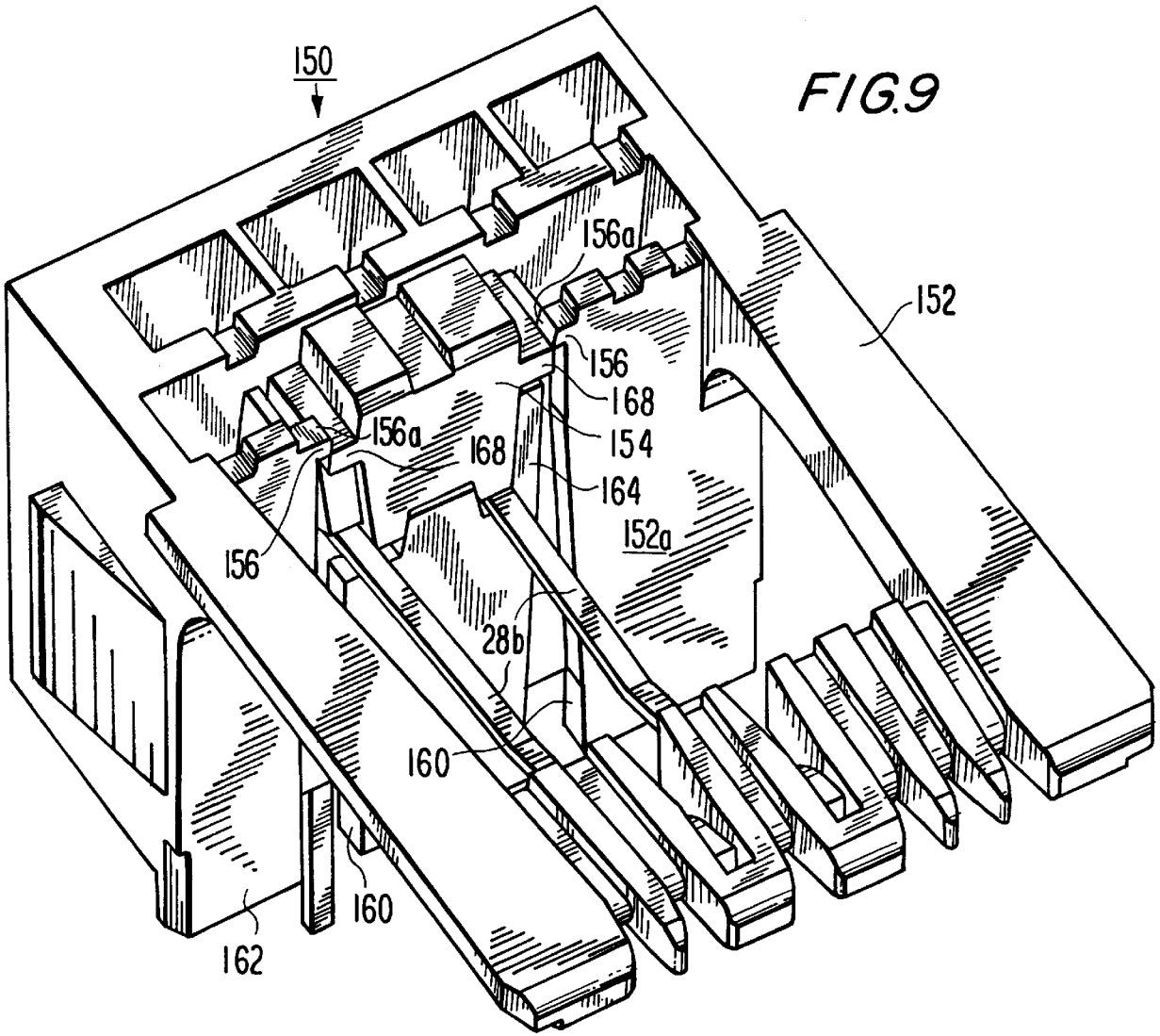
FIG. 9 is a perspective view of another embodiment of an assembly of a contact housing part, securing insert and forward facing contact/terminal members in accordance with the invention.
Figure 11:
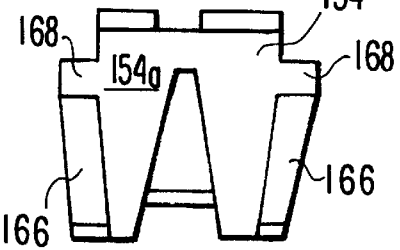
FIG. 11 is a front view of the securing insert of the assembly shown in FIG. 9.
Figure 10:
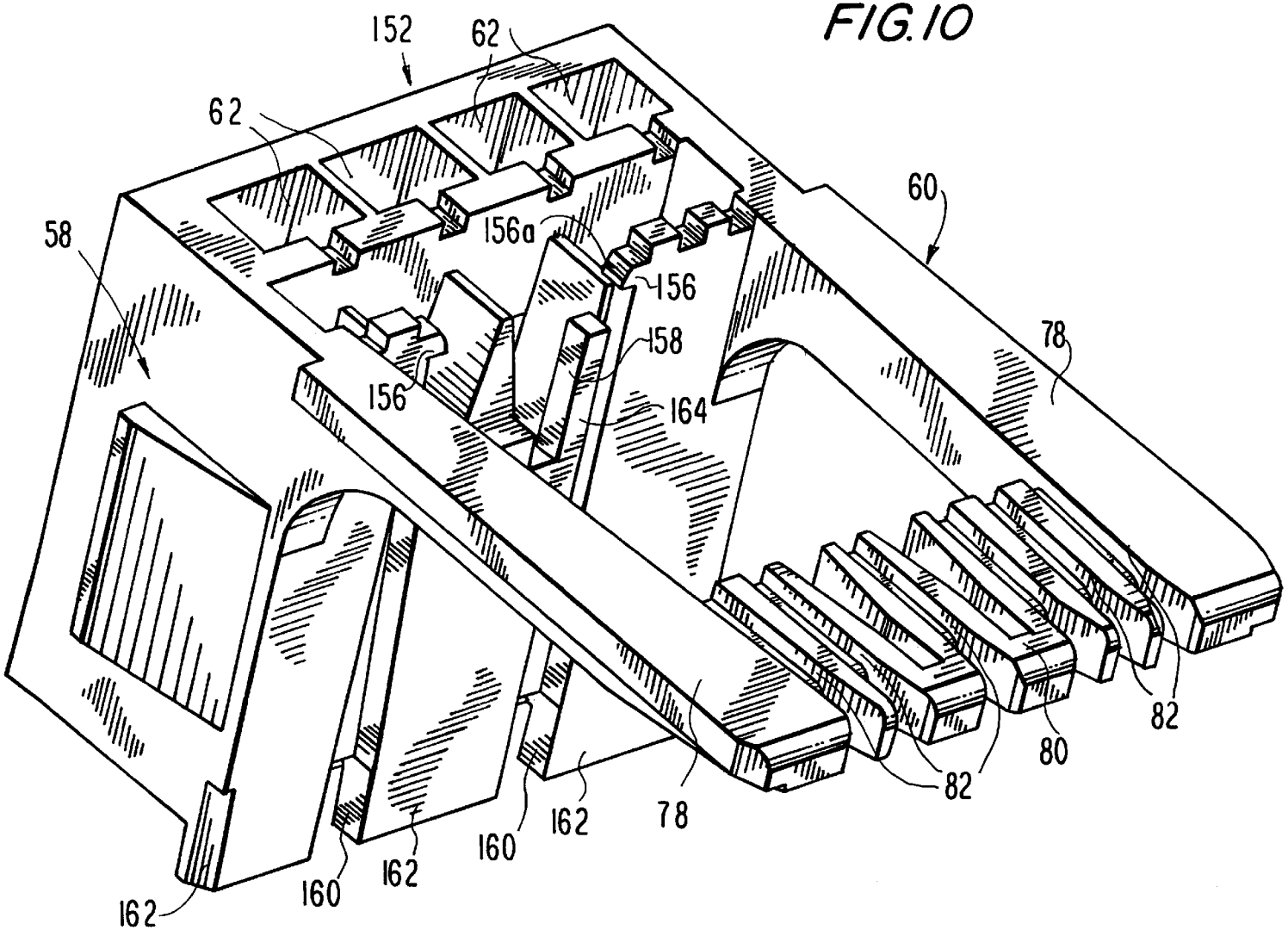
FIG. 10 is a perspective view of the contact housing part of the assembly shown in FIG. 9.

Referring now to FIGS. 9–11, a second embodiment of an insert assembly in accordance with the invention is designated 150 and comprises a contact housing part, designated 152, and cooperating securing insert, designated 154. The insert assembly 150 also comprises forward facing contact/terminal members 28*b* and rearward facing contact/terminal members 28*a* (not shown). In this embodiment, the front wall 152*a* of the contact housing part 152 includes a pair of latches 156 facing one another across the notch 158. Latches 156 each have an angled surface 156*a* angling toward the notch 158 to aid in insertion of the securing insert 154 into the notch 158. Grooves 160 are formed in the front wall 152*a* below the latches 156 and taper outward toward the lower edge of the front wall 152*a*. Contact housing part 152 also includes flanges 162 as extensions of the front wall. A post 164 is formed on one side of the notch 158 and cooperates with a recess 166 in the front face 154*a* of the securing insert 154 to inhibit forward motion of the securing insert 154. Formation of the recesses 166 in the front face 154*a* of the securing insert 154 results in the formation of projections 168 adjacent the front face 154*a* of the securing insert 154 on each side of the securing insert 154.

To insert the securing insert 154 into the notch 158 (after the forward facing contact/terminal members 28*b* are mounted in the contact housing part 152), the lower surface of each projection 168 is pressed against the respective angled surface 156*a* and forced downward until the projections 168 are seated below the latches 156 (FIG. 9). In this situation, the upper surface of the projections 168 is in engagement with a lower surface of the latches 156 thereby preventing upward movement of the securing insert 154 out of the notch 158. Also, the post 164 is received in an aligning recess 166 such that forward movement of the securing insert 154 out of the notch 158 is prevented.

By providing the cooperating means (latches 156 and projections 168) for securing the securing insert 154 to the contact housing part 152, several advantages are obtained. The presence of the latches 156 enables flexibility in manufacturing processes and manufacturing locations because a discrete sub-assembly of the forward facing contact/terminal members and contact housing part is thereby formed and is transferrable between manufacturing locations. That is, the forward facing contact/terminal members are held in place by the securing insert which in turn is held in place by the engagement of the projections 168 and latches 156. As such, it is possible to construct automated processes receivable of such sub-assemblies.

Figure 12:
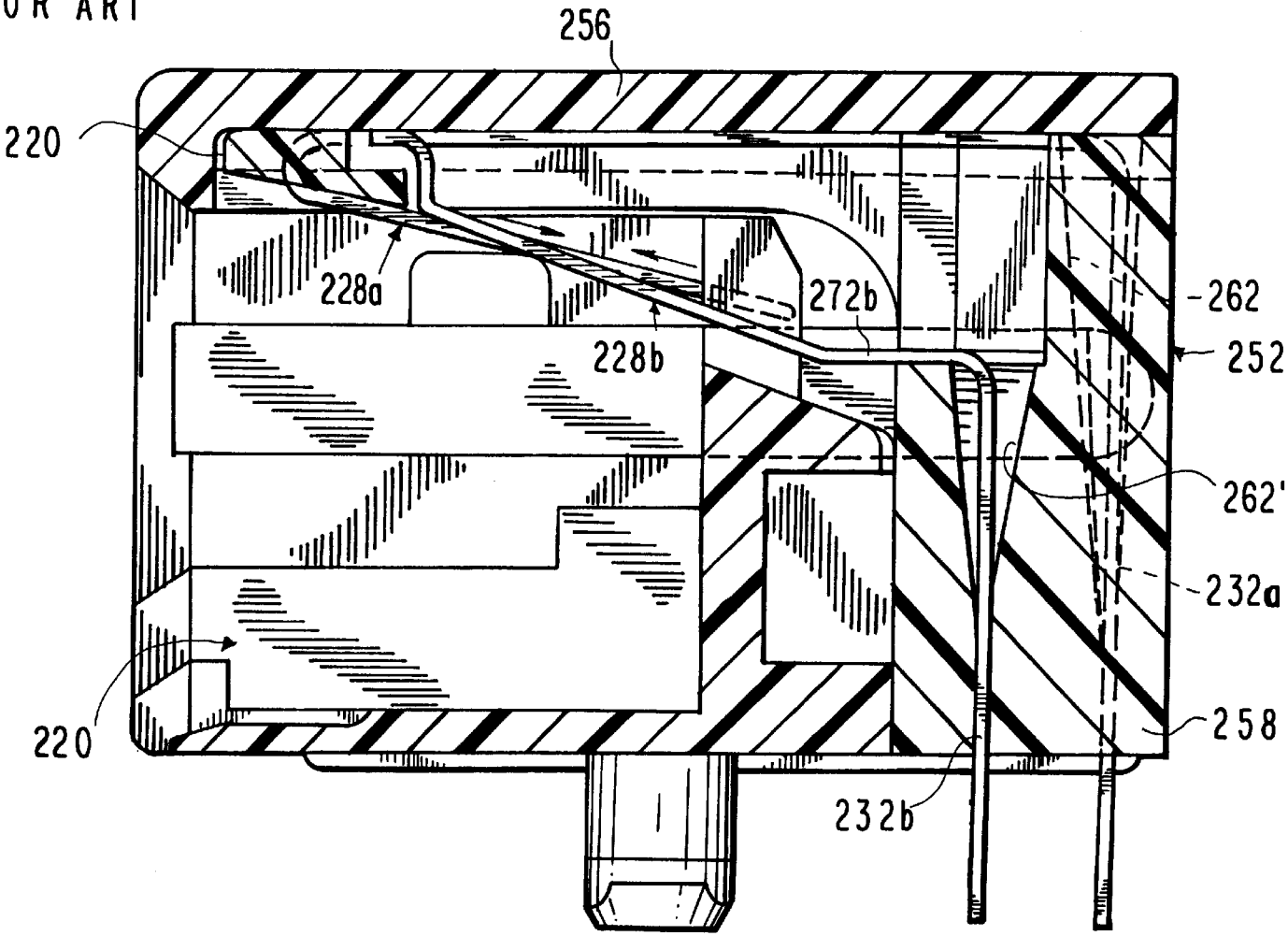
FIG. 12 PRIOR ART
FIG. 12 is a longitudinal section view of the prior art connector assembly of the '266 and '942 patents referenced above.

Referring to FIG. 12, a prior art connector assembly of the type described in the '266 and '942 patents referenced above is shown and the common elements with the connector assembly 10 in accordance with the invention are designated by the reference numeral for each element with a "2" in front. As in FIG. 4, the rearward facing and forward facing contacts of the contact/terminal members 228*a*,228*b* are in their deflected position. A notch 202 is formed in the front wall 268 of the back portion 258 of the contact housing part 252. The conductors 272*b* of contact/terminal members 228*b* extend through the notch 202 while the space between the conductors 272*b* and the outer housing part 256 remains open. As such, the contact/terminal members 228*b* are not firmly held in place in the connector assembly 210 and thus, in the absence of being heat-staked or glued by means of epoxy, the contact/terminal members 228*b* are susceptible to movement during installation of the connector assembly on a printed circuit board.

Obviously, numerous modifications and variations of the present invention are possible in light of the above teachings. For example, although only a single-port connector assembly is shown, it is contemplated that the sub-assembly of the contact housing part, securing insert and contact/terminal members may be utilized in multi-port and/or multi-level connector assemblies, e.g., in a lower row of receptacles in a multi-level connector assembly. One particular use of the sub-assembly is in a multi-port, bi-level connector assembly shown in U.S. patent application Ser. No. 09/169,627 filed Oct. 9, 1998, incorporated by reference herein in its entirety. The upper row of receptacles in the bi-level connector assembly could include the insert assemblies disclosed in U.S. patent application Ser. No. 09/324,164 filed Jun. 2, 1999.

Furthermore, the invention may be applied in connectors other than of a type adapted for use with cables whose wires are assigned to contacts in a manner other than as specified by EIA/TIA standard 568 of ANSI. For example, the arrangement of forward and rearward facing contacts may vary from that shown and described. Connectors in accordance with the invention may be other than of a type adapted for connection to printed circuit boards, and other configurations of conductors, terminals and contacts are possible in accordance with the invention. The connector assembly in accordance with the invention may also be used in externally shielded products, i.e., the outer housing part may be surrounded by a metallic shield. Accordingly, it is understood that other embodiments of the invention are possible in the light of the above teachings.

We claim:

1. An electrical connector assembly, comprising:

a housing defining a receptacle having an entrance opening, and an insert assembly arranged in said housing and including a plurality of contact/terminal members, at least one of said contact/terminal members being a forward facing contact/terminal member including a forward facing contact situated in said receptacle and a non-contact portion including a terminal, said forward facing contact of said forward facing contact/terminal member having a rearward end coupled to said terminal and a forward end which is closer to said entrance opening than said rearward end, said forward facing contact/terminal member further including an end tip arranged at said forward end of said forward facing contact, a securing insert for securing said forward facing contact/terminal member in said housing to prevent movement of at least said forward facing contact of said forward facing contact/terminal member, and a contact housing part including a back portion having a front wall and a notch formed in said front wall continuous with an upper surface of said back portion, said securing insert being insertable into said notch in said contact housing part.

2. The connector assembly of claim 1, wherein said securing insert is arranged to engage a portion of said non-contact portion of said forward facing contact/terminal member.

3. The connector assembly of claim 1, wherein said non-contact portion of said forward facing contact/terminal member includes an intermediate conductor portion arranged between said rearward end of said forward facing contact and said terminal, said securing insert being arranged to engage said intermediate conductor portion.

4. The connector assembly of claim 1, wherein said forward facing contact/terminal member overlies a surface defining said notch such that a portion of said forward facing contact/terminal member is secured between said securing insert and said surface defining said notch.

5. The connector assembly of claim 1, wherein said contact housing part includes at least one bore for receiving said terminal of a respective one of said forward facing contact/terminal members, said at least one bore being defined in part by said front wall, said notch communicating with said at least one bore such that said forward facing contact/terminal member passes from said at least one bore through said notch.

6. The connector assembly of claim 1, wherein said back portion of said contact housing part has at least one bore for receiving said terminal of a respective one of said forward facing contact/terminal members, said securing insert including at least one tapering leg adapted to be inserted into a respective one of said at least one bore.

7. The connector assembly of claim 1, wherein said securing insert has a front wall defining opposed recessed shoulders, said front wall of said securing insert being flush with said front wall of said back portion of said contact housing part.

8. The connector assembly of claim 1, wherein said at least two of said contact/terminal members are forward facing contact terminal members, said back portion having two bores for receiving said terminal of a respective one of said two forward facing contact/terminal members, said bores being defined in part by said front wall, said securing insert including a bottom wall having a notch therein to thereby define two tapering legs, each of said tapering legs being insertable into a respective one of said two bores.

9. The connector assembly of claim 1, wherein said securing insert is separate from said contact housing part.

10. The connector assembly of claim 1, wherein said securing insert has a width less than that of said contact housing part.

11. The connector assembly of claim 1, wherein one of said contact/terminal members is a rearward facing contact/terminal member including a rearward facing contact situated in said receptacle and having a rearward end and a forward end which is closer to said entrance opening than said rearward end, an end tip arranged at said rearward end of said rearward facing contact, a terminal coupled to said forward end of said rearward facing contact and an intermediate conductor portion arranged between said forward end of said rearward facing contact and said terminal, said securing insert being arranged between said forward facing contact/terminal member and said rearward facing contact/terminal member.

12. The connector assembly of claim 11, wherein said securing insert has a top wall defining a channel adapted to receive said intermediate conductor portion of said rearward facing contact/terminal member.

13. The connector assembly of claim 1, wherein at least one of said contact/terminal members is a rearward facing contact/terminal member including a rearward facing contact situated in said receptacle and having a rearward end and a forward end which is closer to said entrance opening than said rearward end, an end tip arranged at said rearward end of said rearward facing contact and a terminal coupled to said forward end of said rearward facing contact.

14. The connector assembly of claim 13, wherein said rearward facing contact of said at least one rearward facing contact/terminal member is substantially parallel and laterally adjacent to said forward facing contact of said forward facing contact/terminal member.

15. The connector assembly of claim 13, wherein at least two of said contact/terminal members are forward facing contact/terminal members and said at least one rearward facing contact/terminal member comprises two rearward facing contact/terminal members, said forward and rearward facing contact/terminal members alternating in position with each other.

16. The connector assembly of claim 13, wherein at least two of said contact/terminal members are forward facing contact/terminal members and said at least one rearward facing contact/terminal member comprises six rearward facing contact/terminal members, said forward facing and rearward facing contacts of said forward and rearward facing contact/terminal members occupying positions designated 1 to 8 and being arranged such that said two forward facing contacts and two of said rearward facing contacts occupy positions 3 to 6 in alternating relationship with each other, and the remaining four of said rearward facing contacts occupy positions 1, 2, 7 and 8.

17. The connector assembly of claim 13, wherein at least two of said contact/terminal members are forward facing contact/terminal members and said at least one rearward facing contact/terminal member comprises six rearward facing contact/terminal members, said forward facing and rearward facing contacts of said forward and rearward facing contact/terminal members occupying positions designated 1 to 8 and being arranged to occupy the eight positions as follows: RRFRFRRR, wherein R designates a rearward facing contact and F designates a forward facing contact.

18. The connector assembly of claim 1, wherein said securing insert and said contact housing part include cooperating securing means for securing said securing insert in connection with said contact housing part.

19. The connector assembly of claim 18, wherein said cooperating securing means comprises latches arranged on said contact housing part and projections defined on said securing insert whereby at least one of said projection is positioned between portions of said contact housing part to inhibit removal of said securing insert from said contact housing part.

20. An electrical connector assembly comprising:

a housing having a receptacle face;

a plurality of elongate contacts arranged in said housing, each of said contacts having a first forward end region and a second rearward end region;

a plurality of terminals arranged at least partially in said housing;

a first conductor for interconnecting a first one of said contacts from said first forward end region thereof to a first one of said terminals, said second rearward end region of said first contact constituting a free rearwardly facing end region; and a second conductor for interconnecting a second one of said contacts situated adjacent to said first contact from said second rearward end region thereof to a second one of said terminals, said first forward end region of said second contact constituting a free forwardly facing end region;

said housing comprising an insert assembly including a securing insert for securing said second conductor in said housing and a contact housing part including a notch, said securing insert being insertable into said notch in said contact housing part.

21. The connector assembly of claim 20, wherein said second conductor overlies a surface defining said notch such that a portion of said second conductor is secured between said securing insert and said surface defining said notch.

22. The connector assembly of claim 20, further comprising a third conductor for interconnecting a third one of said contacts from said first forward end region thereof to a third one of said terminals, said second rearward end region of said third contact constituting a free rearwardly facing end region; and a fourth conductor for interconnecting a fourth one of said contacts from said second rearward end region thereof to a fourth one of said terminals, said first forward end region of said fourth contact constituting a free forwardly facing end region;

said first and third conductors being elongate, substantially parallel to one another and substantially situated in a common first conductor plane, said second and fourth conductors being elongate, substantially parallel to one another and substantially situated in a common second conductor plane spaced from said first conductor plane.

23. The connector assembly of claim 20, wherein said securing insert is separate from said contact housing part.

24. An electrical connector assembly comprising:

a housing having a receptacle face;

a plurality of elongate contacts arranged in said housing, each of said contacts having a first forward end region and a second rearward end region;

a plurality of terminals arranged at least partially in said housing;

a first conductor for interconnecting a first one of said contacts from said first forward end region thereof to a first one of said terminals, said second rearward end region of said first contact constituting a free rearwardly facing end region; and a second conductor for interconnecting a second one of said contacts situated adjacent to said first contact from said second rearward end region thereof to a second one of said terminals, said first forward end region of said second contact constituting a free forwardly facing end region;

said housing comprising an insert assembly including a securing insert for securing said second conductor in said housing and a contact housing part, said securing insert being insertable into connection with said contact housing part, said contact housing part including a back portion having at least one bore for receiving said terminal interconnected to said second contact, said securing insert including at least one tapering leg adapted to be inserted into a respective one of said at least one bore.

25. An electrical connector assembly comprising:

a housing having a receptacle face;

a plurality of elongate contacts arranged in said housing, each of said contacts having a first forward end region and a second rearward end region;

a plurality of terminals arranged at least partially in said housing;

a first conductor for interconnecting a first one of said contacts from said first forward end region thereof to a first one of said terminals, said second rearward end region of said first contact constituting a free rearwardly facing end region; and a second conductor for interconnecting a second one of said contacts situated adjacent to said first contact from said second rearward end region thereof to a second one of said terminals, said first forward end region of said second contact constituting a free forwardly facing end region;

said housing comprising an insert assembly including a securing insert for securing said second conductor in said housing and a contact housing part, said securing insert being insertable into connection with said contact housing part, said contact housing part including a back portion having a front wall, said securing insert having a front wall defining opposed recessed shoulders, said shoulders being adapted to receive said front wall of said back portion of said contact housing part such that said front wall of said securing insert is flush with said front wall of said back portion of said contact housing part.

26. An electrical connector assembly comprising:

a housing having a receptacle face;

a plurality of elongate contacts arranged in said housing, each of said contacts having a first forward end region and a second rearward end region;

a plurality of terminals arranged at least partially in said housing;

a first conductor for interconnecting a first one of said contacts from said first forward end region thereof to a first one of said terminals, said second rearward end region of said first contact constituting a free rearwardly facing end region;

a second conductor for interconnecting a second one of said contacts situated adjacent to said first contact from said second rearward end region thereof to a second one of said terminals, said first forward end region of said second contact constituting a free forwardly facing end region; and a third conductor for interconnecting a third one of said contacts from said second rearward end region thereof to third one of said terminals, said first forward end region of said third contact constituting a free forwardly facing end region said housing comprising an insert assembly including a securing insert for securing said second conductor in said housing and a contact housing part including a back portion having a front wall and two bores for receiving said terminal interconnected to said second and third contacts, said bores being defined in part by said front wall, said securing insert including a bottom wall having a notch therein to thereby define two tapering legs, each of said tapering legs being insertable into a respective one of said two bores.

27. An electrical connector assembly comprising:

a housing having a receptacle face;

a plurality of elongate contacts arranged in said housing, each of said contacts having a first forward end region and a second rearward end region;

a plurality of terminals arranged at least partially in said housing;

a first conductor for interconnecting a first one of said contacts from said first forward end region thereof to a first one of said terminals, said second rearward end region of said first contact constituting a free rearwardly facing end region; and a second conductor for interconnecting a second one of said contacts situated adjacent to said first contact from said second rearward end region thereof to a second one of said terminals, said first forward end region of said second contact constituting a free forwardly facing end region;

said housing comprising an insert assembly including a securing insert for securing said second conductor in said housing, said securing insert being arranged between said second conductor and said first conductor.

28. The connector assembly of claim 27, wherein said securing insert has a top wall defining a channel adapted to receive said first conductor.

29. An electrical connector assembly comprising:

a housing having a receptacle face;

a plurality of elongate contacts arranged in said housing, each of said contacts having a first forward end region and a second rearward end region;

a plurality of terminals arranged at least partially in said housing;

a first conductor for interconnecting a first one of said contacts from said first forward end region thereof to a first one of said terminals, said second rearward end region of said first contact constituting a free rearwardly facing end region; and a second conductor for interconnecting a second one of said contacts situated adjacent to said first contact from said second rearward end region thereof to a second one of said terminals, said first forward end region of said second contact constituting a free forwardly facing end region;

said housing comprising an insert assembly including a securing insert for securing said second conductor in said housing and a contact housing part, said securing insert and said contact housing part including cooperating securing means for securing said securing insert in connection with said contact housing part.

30. The connector assembly of claim 29, wherein said cooperating securing means comprises latches arranged on said contact housing part and projections defined on said securing insert whereby at least one of said projection is positioned between portions of said contact housing part to inhibit removal of said securing insert from said contact housing part.

* * * * *